United States Patent [19]

Ohnishi

[11] Patent Number: 4,604,977

[45] Date of Patent: Aug. 12, 1986

[54] CENTRIFUGAL GOVERNOR FOR INTERNAL COMBUSTION ENGINES

[75] Inventor: Masanori Ohnishi, Higashimatsuyama, Japan

[73] Assignee: Diesel Kiki Co., Ltd., Tokyo, Japan

[21] Appl. No.: 726,413

[22] Filed: Apr. 24, 1985

[30] Foreign Application Priority Data

May 2, 1984 [JP] Japan ..... 59-64873[U]

[51] Int. Cl.[4] ..... F02M 39/00

[52] U.S. Cl. ..... 123/365; 123/373; 123/179 L

[58] Field of Search ..... 123/365, 366, 368, 373, 123/388, 179 L

[56] References Cited

U.S. PATENT DOCUMENTS

| | | | |
|---|---|---|---|
| 3,572,303 | 3/1971 | Becker | 123/365 |
| 3,727,598 | 4/1973 | Knapp | 123/373 |
| 3,847,127 | 11/1974 | Staudt | 123/366 |
| 3,884,205 | 5/1975 | Staudt | 123/373 |
| 4,204,510 | 5/1980 | Ritter | 123/179 L |
| 4,239,025 | 12/1980 | Konrath | 123/179 L |
| 4,353,340 | 10/1982 | Straubel | 123/365 |

FOREIGN PATENT DOCUMENTS

| | | | |
|---|---|---|---|
| 58-7814 | 2/1983 | Japan | 123/373 |

*Primary Examiner*—Carl Stuart Miller

*Attorney, Agent, or Firm*—Frishauf, Holtz, Goodman & Woodward

[57] ABSTRACT

A centrifugal governor for an internal combustion engine, which includes a sensor lever adapted to engage a cam surface of a torque cam determining a starting fuel increment, at the start of the engine, to displace the control rack into a fuel increasing position, and spring means interposed between the torque cam and the tension lever and urging the torque cam with a force dependent upon the angularity of the tension lever in a direction of disengaging the sensor lever from the cam surface for interrupting the starting fuel increasing action of the governor. The spring means comprises first and second springs, one of which is formed of a thermosensitive material having smaller and larger spring constants at a low temperature below a predetermined value and a temperature above the predetermined value, respectively.

2 Claims, 3 Drawing Figures

CENTRIFUGAL GOVERNOR FOR INTERNAL COMBUSTION ENGINES

BACKGROUND OF THE INVENTION

This invention relates to a centrifugal governor for use with an internal combustion engine, and more particularly to a centrifugal governor of this kind which has a function of increasing the quantity of fuel to be supplied to the engine at the start of same.

A conventional centrifugal governor adapted to increase the fuel supply quantity at the start of the engine is known, e.g. from Japanese Patent Publication No. 58-7814, which comprises a control rack for regulating the quantity of fuel to be supplied to the engine, flyweight members radially displaceable in response to the rotational speed of the engine, a tension lever pivotable about a stationary shaft in response to the radial displacement of the flyweight members, a torque cam having a cam surface determining a fuel increment to be applied at the start of the engine, a sensor lever having one end engaged by the control rack and another end disposed for engagement with the cam surface of the torque cam, the sensor lever being adapted to engage with the cam surface of the torque cam when the engine is in a starting condition, to cause displacement of the control rack inito a fuel increasing positin for the start of the engine, and spring means interposed between the torque cam and the tension lever and urging the torque cam with a force dependent upon the angularity of the tension lever in a direction of disengaging the sensor lever from the cam surface of the torque cam. In the centrifugal governor of this type, the urging force of the spring means is determined by the angularity of the tension lever dependent upon radial displacement of the flyweight members, i.e. the rotational speed of the engine. Therefore, if the engine speed increases while the engine is still in a starting condition requiring increase of the fuel supply quantity, the sensor lever can become disengaged from the torque cam, resulting in interruption of the fuel increasing action. This can degrade the startability of the engine particularly when the engine is started in a low temperature condition.

SUMMARY OF THE INVENTION

It is the object of the invention to provide a centrifugal governor for use with an internal combustion engine, which can prevent the fuel increasing action of the governor from being interrupted by disengagement of the sensor lever from the torque cam when the engine is still in a warming-up condition after starting the engine particularly in a low temperature condition, to thereby ensure prompt warming-up of the engine and smooth and positive startability of same.

According to the invention, a centrifugal governor includes spring means comprising first and second springs, one of the which is formed of a thermosensitive material having a smaller spring constant at a temperature below a predetermined value, and a larger spring constant at a temperature above the predetermined value.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
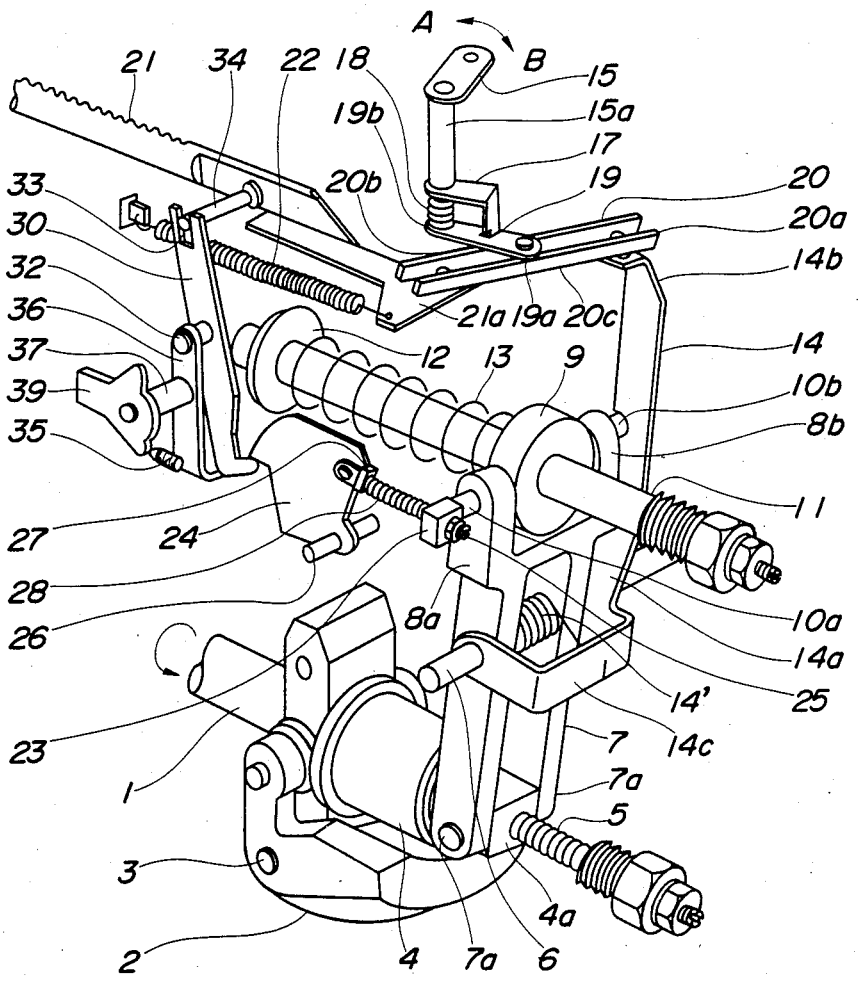
FIG. 1 is a perspective view showing the internal arrangement of a centrifugal governor according to the invention.

Referring first to FIG. 1, there is illustrated a centrifugal governor for use in a fuel injection pump, according to the present invention. A camshaft 1 of the fuel injection pump is coupled to flyweight members 2, only one of which is shown, and which are responsive to changes in the rotational speed of an engine to move radially about pins 3 supported by a flyweight holder, not shown. A sleeve 4 engages the flyweight members 2 so that it is displaced rightward as viewed in FIG. 1, along the axis of the camshaft 1 as the flyweight members 2 move radially outwardly. An idling spring 5 is interposed between a right end face 4*a* of the sleeve 4 and a governor casing, not shown, to apply its force against rightward displacement of the sleeve 4. Connected to the sleeve 4 is a lower end portion 7*a* of a tension lever 7 which is pivotably supported at its intermediate portion by a shaft 6 supported by the governor casing. A pair of brackets 8*a* and 8*b* project integrally from an upper end portion of the tension lever 7 in a manner spaced from each other, and carry pins 10*a* and 10*b*, respectively, for holding a spring seat 9 therebetween. A governor shaft 11 extends through the spring seat 9 and has another spring seat 12 at its one end portion close to the flyweight members 2. A governor spring 13, formed of a coiled spring, is interposed between these spring seats 12 and 9. Thus, during operation, the tension lever 7 is displaced to a position where equilibrium is established between the force of the sleeve 4 urging the lower end portion 7*a* of the tension lever 7 in the rightward direction due to radially outward displacement of the flyweight members 2, and the combined force of the idling spring 5 and the governor spring 13 counteracting the urging force of the sleeve 4.

A guide lever 14 is pivotably supported at its lower end portion 14*a* by the tension lever shaft 6 and has an upper end 14*b* supported by a bifurcated end portion 20*a* of a floating lever 20, hereinafter referred to. An arm 14*c* extends integrally from the lower end 14*a* of the guide lever 14 at right angles thereto and parallel with the axis of the shaft 6, and is engaged by a return spring 14' disposed around the shaft 6. Thus, the guide lever 14 is pivotable about the shaft 6 in unison with the tension lever 7 with its side surface in urging contact with the pin 10*b* by the force of the return spring 14'.

The floating lever 20 engages at its other bifurcated end portion 20*b* with a base 21*a* of a control rack 21, and is pivotably supported at its intermediate portion 20*c* by one end 19*a* of a supporting lever 19. The supporting lever 19 has its other end 19*b* pivotably supported by a shaft 15*a* of a control lever 15 which in turn is supported by the governor casing. An L-shaped lever 17 is secured to the control lever shaft 15*a* for urging engagement with the supporting lever 19. The supporting lever 19 is acted upon by a return spring 18 provided at its other end 19*b* for pivotal displacement about the shaft 15*a* into urging contact with the L-shaped lever 17. When the supporting lever 19 is thus engaged with the lever 17, it is pivotally displaced in unison with the control lever 15. The control rack 21 is pulled by a starting spring 22 connected to the base 21*a* of the control rack 21, in the leftward direction as viewed in FIG. 1, i.e. in such a direction as to cause the fuel injection pump to increase the quantity of fuel to be supplied to the engine.

Figure 2:
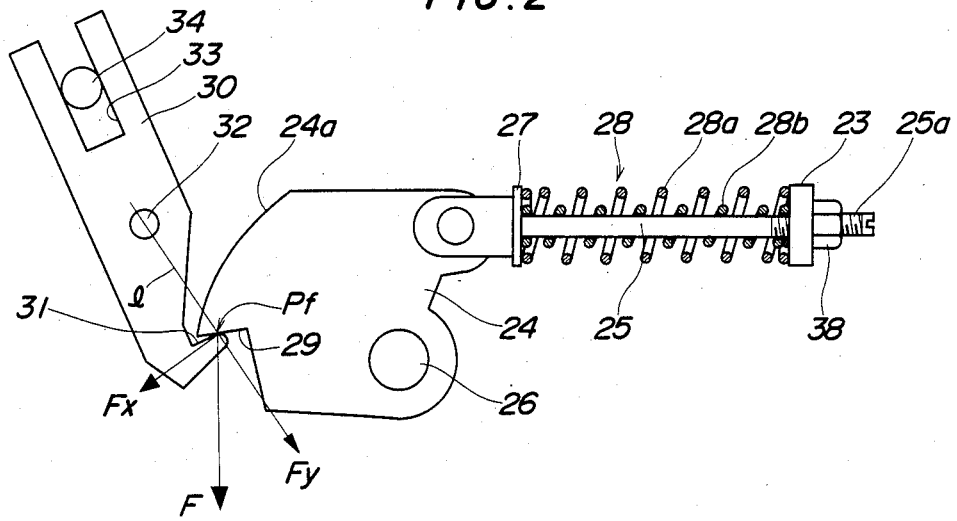
FIG. 2 is an enlarged view, showing a torque cam and a sensor lever in FIG. 1, in engagement with each other.

Referring now to FIG. 2, the pin 10*a* supported by the bracket 8*a* of the tension lever 7 has an integral spring seat 23 into which a threaded end 25*a* of a rod 25 is fitted. The rod 25 has its other end pivoted to a torque cam. The torque cam 24 is arranged at a location slightly lower than the rod 25 and pivotable about a pin 26 supported by the governor casing. A cancelling spring 28 is interposed between a spring seat 27 formed on the other end of the rod 25 and the spring seat 23, to urge the torque cam 24 in the counterclockwise direction. An adjusting nut 38 is threadedly fitted on the threaded end 25*a* of the rod 25 to set the effective length of the rod 25 to a predetermined value.

The torque cam 24 has a cam surface 24*a* with its tip cut off to form a nose or engaging portion 29 which is engageable with an engaging tip 31 of a lower end of the sensor lever 30. The sensor lever 30 is pivotably supported by a pin 32 at its longitudinally intermediate portion and has a U-shaped groove 33 formed in its upper end portion. The groove 33 is engaged by an engaging pin 34 projecting from a side surface of the control rack 21 so that displacement of the control rack 21 causes pivotal movement of the sensor lever 30 about the pin 32. The pin 32 supporting the sensor lever 30 is in turn supported by a lever 36 which is disposed for pivotal movement in unison with a full load setting lever 39 through a shaft 37 supported by the governor casing. The full load setting lever 39 has its angular position adjusted by a full load setting screw 35. Therefore, by adjusting the full load setting screw 35, the center of pivotal movement of the sensor lever 30 can be set to a desired position to thereby set an extreme position of the control rack 21 at full load operation of the engine.

Fuel increasing action of the centrifugal governor takes place at the start of the engine, in the following manner:

While the engine is at rest, no centrifugal force is produced by the flyweight members 2, and accordingly the force of the idling spring 5 alone acts upon the lower end 7*a* of the tension lever 7 in the leftward direction as viewed in FIG. 1, to urge same toward a position corresponding to no lifting of the flyweight members 2. Therefore, the torque cam 24 is then pulled upward by the rod 25 as shown in FIG. 2. With this governor position, if the control lever 15 is operated in a direction indicated by the arrow A in FIG. 1 to a full speed position, the supporting lever 19 follows the control lever 15 due to the force of the return spring 18, to cause pivotal displacement of the floating lever 20 about its one end 20*a* engaging with the upper end 14b of the guide lever 14, thereby moving the control rack 21 in a fuel increasing direction. On this occasion, the pin 34 projecting from the control rack 21 causes counterclockwise displacement of the sensor lever 30 about the pin 32. Since the torque cam 24 is then in a pulled-up position as stated before, the sensor lever 30 has its engaging portion 31 engaged in the cut-off portion 29 formed in the tip of the torque cam 24, as shown in Fig. 2. Thus, by moving the control lever 1 to the full speed position at stoppage of the engine, the control rack 21 can be displaced to a fuel increasing position for the start of the engine, beyond the extreme position at full load operation of the engine, hereinafter referred to, which is determined by the cooperation of the torque cam 24 and the sensor lever 30.

Figure 3:
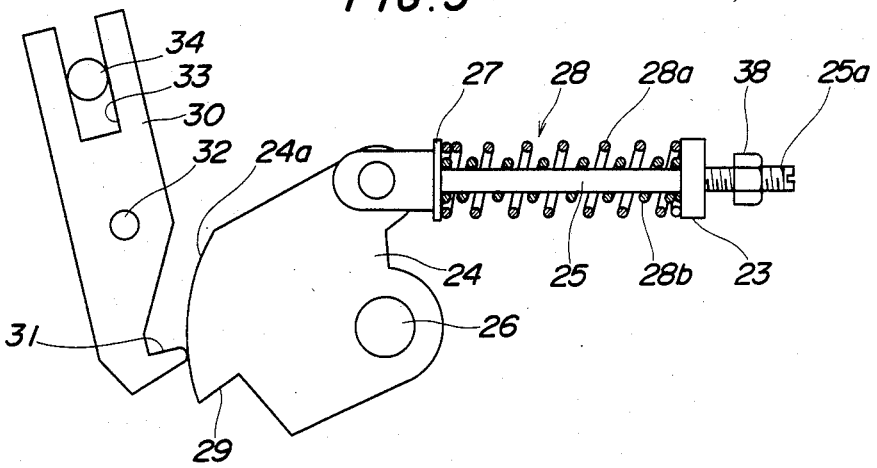
FIG. 3 is a view similar to FIG. 2, showing the torque cam and the sensor lever in a state disengaged from each other due to the urging force of spring means.

As the rotational speed of the engine increases after the start of the engine, the flyweight members 2 move radially outwardly so that rightward movement of the sleeve 4 causes pivotal displacement of the tension lever 7 in the counterclockwise direction. This pivotal displacement of the tension lever 7 causes large compression of the spring means 28 through the spring seat 23 to increase the urging force of same acting upon the torque cam 24 to move same in the counterclockwise direction. The increased urging force of the spring means 28 is applied to the engaging portion 31 of the sensor lever 30 as a force F in FIG. 2, through the engaging portion 29 of the torque cam 24. Part of the force F creates a moment to pivotally displace the sensor lever 30 in a direction of disengaging the sensor lever 30 from the torque cam 24. That is, the force F can be divided into a component Fy acting in a direction along a line 1 passing the point of application Pf and the center of pivotal displacement of the sensor lever 30, and a component Fx acting in a direction perpendicular to the line 1. When the force component Fx acting to pivotally displace the sensor lever 30 surpasses the counteracting force imparted by the starting spring 22 and the return spring 18, the sensor lever 30 becomes disengaged from the torque cam 24, into a position as shown in FIG. 3 wherein the cam surface 24*a* of the torque cam 24 urges the lower end portion of the sensor lever 30 to pivotally displace same in the clockwise direction about the pin 32. Accordingly, the control rack 21 is moved back in the rightward or fuel decreasing direction, to terminate the fuel increasing action for the start of the engine, followed by control of the fuel supply quantity in a normal manner by the governor. Once the sensor lever 30 is disengaged from the torque cam 24, the engaging portion 31 of the sensor lever 30 does not engage in the cut-off portion 29 of the torque cam 24 so long as the engine continues rotating, thereby preventing the control rack 21 from moving to the fuel increasing position for the start of the engine.

According to the present invention, the spring means 28 urging the torque cam 24 comprises a pair of coiled springs 28*a* and 28*b* concentrically disposed around the rod 25, as shown in FIGS. 2 and 3. One of the coiled springs, i.e. the spring 28*a*, is formed of an elastic material generally used for coil springs and has a spring constant of Ka, while the other spring 28*b* is formed of a thermosensitive material such as a shape memory alloy, which has a spring constant variable between a value Kb at a normal temperature and a value K0 smaller than the value Kb and almost equal to zero at a low temperature below its transformation point Tz. The springs 28*a*, 28*b* are so designed as to satisfy the relationship of $Ka+Kb=K$, where K represents a conventional spring constant of the spring means 28 at a normal temperature. Therefore, the relationship of $Ka+K\text{-}0<K$ stands at a low temperature below the transformation point Tz. As the engine rotational speed increases after starting of the engine in a low temperature condition, the tension lever 7 moves close to the torque cam 24, to largely compress both the springs 28*a*, 28*b* in the same manner as described hereinbefore. However, since in a low temperature condition, the spring 28*b* formed of a shape memory alloy has the spring constant K0 which is close to zero, the combined force of the springs 28*a*, 28*b* is not sufficient to cause counterclockwise displacement of the torque cam 24 to such a degree as to disengage the engaging portion 29 of the torque cam 24 from the engaging portion 31 of the sensor lever 30, against the combined force of the starting spring 22 and the return spring 18. Therefore, the fuel increasing action of the governor for the start of the engine is not interrupted in a low temperature condition until the engine speed becomes high, to thereby facilitate the startability of the engine.

While in a normal temperature condition, the force of the spring 28*b* becomes so large that the relationship of $Ka+Kb=K$ stands. Therefore, when the rotational speed of the engine exceeds a predetermined speed, the fuel increasing action for the start of the engine is interrupted, followed by ordinary control of the fuel supply quantity by the governor as well as by the control lever.

What is claimed is:

1. A centrifugal governor for use with an internal combustion engine, comprising:

a control rack for regulating the quantity of fuel to be supplied to said engine;

flyweights radially displaceable in response to the rotational speed of said engine;

a tension lever pivotable about a stationary fulcrum in response to the radial displacement of said flyweights;

a torque cam having a cam surface determining a fuel increment to be applied at the start of said engine;

a sensor lever having one end engaged by said control rack and another end disposed for engagement with said cam surface of said torque cam, said sensor lever being adapted to engage with said cam surface of said torque cam when said engine is in a starting condition, to cause displacement of said control rack into a fuel increasing position for the start of said engine; and spring means interposed between said torque cam and said tension lever and urging said torque cam with a force dependent upon the angularity of said tension lever in a direction of disengaging said sensor lever from said cam surface of said torque cam;

said spring means comprising first and second springs, one of said first and second springs being formed of a thermosensitive material having a smaller spring constant at a low temperature below a predetermined value, and a larger spring constant at a temperature above said predetermined value; and said first and second springs of said spring means comprising coiled springs disposed concentrically with each other.

2. A centrifugal governor as claimed in claim 1, wherein said thermosensitive material is a shape memory alloy.

* * * * *